US006641931B2

(12) United States Patent
Claessens et al.

(10) Patent No.: US 6,641,931 B2
(45) Date of Patent: Nov. 4, 2003

(54) METHOD OF PRODUCTION OF COLD-ROLLED METAL COATED STEEL PRODUCTS, AND THE PRODUCTS OBTAINED, HAVING A LOW YIELD RATIO

(75) Inventors: Serge Claessens, Deurne (BE); Dirk Vanderschueren, Merelbeke (BE)

(73) Assignee: Sidmar N.V. (BE)

( * ) Notice: Subject to any disclaimer, the term of this patent is extended or adjusted under 35 U.S.C. 154(b) by 0 days.

(21) Appl. No.: 09/733,424

(22) Filed: Dec. 8, 2000

(65) Prior Publication Data

US 2001/0007280 A1 Jul. 12, 2001

(30) Foreign Application Priority Data

Dec. 10, 1999 (EP) ..... 99870257
Dec. 17, 1999 (EP) ..... 99870267

(51) Int. Cl.[7] ..... B32B 15/20; C21D 8/00

(52) U.S. Cl. ..... 428/653; 148/531; 148/533; 148/534; 148/651; 148/653; 148/654; 148/661; 148/662; 148/664; 428/659; 428/939

(58) Field of Search ..... 428/653, 659, 428/939; 427/431, 433, 436; 420/8, 105, 123; 148/531, 533, 534, 651, 653, 654, 661, 662, 664

(56) References Cited

U.S. PATENT DOCUMENTS 4,394,186 A 7/1983 Furukawa et al. ..... 148/632
6,312,536 B1 * 11/2001 Omiya et al. ..... 148/533

FOREIGN PATENT DOCUMENTS

| | | | |
|---|---|---|---|
| EP | 0 040 553 | | 11/1981 |
| EP | 0040553 | A1 * | 11/1981 |
| EP | 0 501 605 | A2 | 9/1992 |
| GB | 1287 178 | | 8/1972 |
| JP | 56047555 | | 4/1981 |
| JP | 56163219 | | 12/1981 |
| JP | 04350152 | | 12/1992 |
| JP | 06057375 | | 1/1994 |

* cited by examiner

*Primary Examiner*—Robert R. Koehler
(74) *Attorney, Agent, or Firm*—Knobbe, Martens, Olson & Bear, LLP

(57) ABSTRACT

The present invention aims to produce a cold rolled metal coated multi-phase steel, characterized by a tensile strength of at least 500 MPa, a yield ratio (Re/Rm) lower than 0.65 in skinned conditions, lower than 0.60 in unskinned conditions, and with good metal coating adhesion behavior. In the case of the aluminized steel according to the invention, the steel also has superior resistance to temperature corrosion up to 900° C. and excellent mechanical properties at this high temperature. The hot metal coated steel product having a steel composition with a manganese content lower than 1.5%, chrome content between 0.2 and 0.5%, molybdenum content between 0.1 and 0.25%, and a relation between the chrome and molybdenum content as follows Cr+2 Mo higher than or equal to 0.7%, undergoes a thermal treatment in the hot dip metal coating line defined by a soaking temperature between Ac1 and Ac3, a primary cooling speed higher than 25° C./sec and a secondary cooling speed higher than 4° C./sec.

10 Claims, 7 Drawing Sheets

METHOD OF PRODUCTION OF COLD-ROLLED METAL COATED STEEL PRODUCTS, AND THE PRODUCTS OBTAINED, HAVING A LOW YIELD RATIO

FIELD OF THE INVENTION

The present invention is related to a method of production of a high strength cold-rolled metal coated steel product.

The present invention is also related to the direct products obtained by the method mentioned here above.

DESCRIPTION OF THE RELATED ART

There is a need in the automobile field for cold-rolled hot dip coated steel products having a low yield ratio as well as a tensile strength comprised between 500 MPa and 800 MPa, likewise for steel grades with a high temperature corrosion resistance up to 900° C. in combination with good mechanical properties during and after their use at these high temperatures.

Those steels are also commonly called multi-phase steels or preferably dual phase steels.

Document U.S. Pat. No. 4,394,186 is describing dual phase steel sheets having as major constituents a phase being ferrite and at least another phase being either martensite or bainite or retained austenite. These steel sheets have a low yield ratio, of approximately 0.6, and are free from yield point elongation. The production method for obtaining uncoated steel sheets is to heat the steel in a continuous annealing line at a temperature within the intercritical region followed by a quenching in one step (called primary cooling R1) from the annealing temperature to a temperature lower than 200° C. with an average cooling rate comprised between 1° C. and 30° C. per second. The composition of the steel has a carbon content comprised between 0.01 to 0.3% with a manganese content comprised between 0.7 and 1.7%.

The production method for obtaining a hot dip coated steel is to heat the steel in a continuous annealing line at a temperature within the intercritical region followed by a quenching in two steps: in the first quenching step, the strip is quenched (primary cooling R1) down to a temperature between 420° C. and 700° C. (molten zinc bath temperature) at a cooling rate comprised within the range of 1° C./sec<R1<30° C./sec, the second quenching step (secondary cooling R2) consists in a quenching from the molten bath temperature to a temperature lower than 200° C. at a cooling rate within the range of 100° C./sec<R2<300° C./sec. The first quenching step is to avoid the transformation of austenite to perlite, the second quenching step is performed to obtain the transformation of the austenite into martensite. The described high (between 100° C. and 300° C. per second) secondary cooling rate (R2) of the steel strip which is still covered with molten metal, is probably feasible at laboratory scale, but in the industrial technology of today this quenching is not feasible. Indeed, after the molten metal coating bath the coated strip (with molten metal at its surface) is cooled in open air (no forced air cooling) during its vertical transfer to the wiping knifes (regulation of the layer thickness) and is then cooled in a vertical cooling device, to ensure the same layer thickness on both sides. A cooling rate, higher than 50° C. per second can only be achieved by roll quenching, which is not applicable in said method due to the molten layer, or by water quenching, which is impossible to apply in said method on a molten metal surface and above a molten metal bath. Those two quenching methods are applied on uncoated steel surfaces.

So far in the state of the art, no industrial galvanising line has been equipped with such quenching devices used for secondary quenching.

EP-A-0501605 describes a galvanised steel sheet, which has a tensile strength not less than 800 MPa and a yield ratio lower than 0.6. This steel contains carbon, manganese, niobium, titanium and boron and has a dual phase structure. After annealing at a temperature comprised between Ac3−30° C. to Ac3+70° C. the steel sheet is cooled at a rate higher than 50° C. per second down to a temperature comprised between 450° C. and 550° C. This controlled cooling step should avoid that the perlite transformation occurs. The addition of manganese and chrome as alloying elements as a way of obtaining quenching structures is well known. Those elements have however a very detrimental effect on the adhesion of the coating metal on the steel surface.

JP-A-4350152 describes the manufacture of a galvanised steel sheet having a molybdenum content comprised between 0.005 and 0.5%, a boron-content comprised between 4 and 50 ppm, a silicon-content less than 0.5% and a carbon-content comprised between 0.01 and 0.2% with the presence of some Mn, Al and Ti elements. The annealing temperature at the galvanising line lies higher than Ac3. The cooling is performed at a cooling rate higher than 50° C. per second. This method has two main disadvantages: the high annealing temperature of above Ac3 is very expensive and the high cooling rate (>50° C./second) in the secondary cooling, is hardly feasible industrially.

JP-A-56047555 is describing the manufacture of a galvanised steel plate by annealing a cold rolled steel strip through a continuous hot dip galvanising line. The steel composition consists of 0.02–0.07% C, 1.5–2.5% Mn, 0.5–1% Cr, 0.01–0.1% Al, 0.07% or less Si, and the remaining is Fe. The Mn, Cr and C-contents are defined by the following relation:

$$C+0.06\ Mn+0.03\ Cr>0.17\%.$$

The steel strip is soaked between the transformation temperatures Ac1 and Ac3, and soon passed through the hot galvanising bath of the said hot dip galvanising line to obtain the galvanised steel plate having a low yield ratio of approx. 0.7 or less and a tensile strength of approx. 450 MPa or more. The high Mn (>1.5%) and Cr (>0.5%) concentrations have such a detrimental effect on the zinc adhesion that it is virtually impossible to obtain a defect free zinc layer for industrial applications. This is due to the heavy manganese and chrome oxides formed at the strip surface before entering the zinc bath.

JP-A-56163219 is describing a cold rolled high-tensile galvanised steel strip whereby a slab of the steel consisting of 0.02–0.15% C, 1.6–3.0% Mn, 0.1–1.0% Cr, less than 0.1% Si, 0.01–0.10% Al and the balance Fe with unavoidable impurities and satisfying the following relation: Mn %+½Cr % higher than or equal to 1.9%, is hot-rolled, pickled and cold-rolled to obtain a cold-rolled steel strip. Then, the slab is heated at an annealing temperature between Ac1 and Ac3 with an in-line annealing type continuous galvanising device and is immediately passed through a galvanising bath, whereby it is plated. The average cooling rates up to the execution of the hot dipping after the in-line annealing are preferably about 2–8° C./sec and the average cooling rates down to about 350° C. after the plating are preferably about 3–8° C./sec. The high Mn (>1.5%) and Cr (>0.5%) concentrations have such a detrimental effect on the zinc adhesion that it is virtually impossible to obtain a defect free zinc layer for industrial applications. This is due to the heavy manganese and chrome oxides formed at the strip surface before entering the zinc bath.

Aluminising steel according to the above described process of annealing and cooling in two steps is also a known technique. For high temperature applications, a combination of a good adhesion of the coating, together with a low decrease in strength because of the use at high temperature is necessary. Aluminium coatings on standard commercial sheet steels show a poor temperature corrosion resistance above 650° C., because of the formation of brittle Al—Fe—Si-compounds.

By adding alloying elements like Ti in the steel, aluminised steel grades have been made commercially available in the past with a high temperature corrosion resistance up to 800° C. One commercial steel grade is known to have a good behaviour at 900° C. A weakness of those steels is the continuous decrease in strength during the use time, related to the time spent at high temperature. To thwart the decrease in strength in this existing grade considerable amounts of Ti and Nb are added to the steel in order to inhibit the ferrite grain growth. However, by doing this, the decrease in strength is only retarded.

Document JP-A-6057375 is describing an ultrahigh tensile strength steel sheet containing high amounts of Cr (>0.5 to 1.3%), which is detrimental for obtaining a defect-free metal coating layer.

Document GB-A-1287178 describes a method of manufacturing steel sheet having deep drawability at normal temperatures and heat resistance at high temperatures. High Cr-content equally results in bad quality of metal coating layers, such as obtained by galvanising or aluminising.

Document EP-A-040553 describes a process for producing dual-phase steel, characterised by a low coiling temperature (350° C.–580° C.) after hot rolling. No specific effort is described to improve the quality of metal coating on the resulting steel sheet.

SUMMARY OF THE INVENTION

The present invention aims to produce a cold-rolled hot-dip metal coated multi-phase steel, having a tensile strength of at least 500 MPa, and a yield ratio (Re/Rm) lower than 0.65 in skinned condition and lower than 0.60 in unskinned condition.

The present invention aims to suggest a high strength steel with good formability and good metal coating adhesion behaviour, which are required for instance by the automobile industry for unexposed and exposed parts.

A further aim is to suggest an aluminised steel having a high temperature corrosion resistance up to 900° C., good coating adhesion and good strength properties during and after its use at these high temperatures.

The present invention relates to a method and a composition for producing a cold-rolled steel sheet with multiphase structure and more particularly to a method and a composition for producing a cold-rolled metal coated steel sheet having excellent formability, high strength, low yield ratio and high ductility.

More specific for the aluminised steel the present invention makes it possible to obtain an increase in strength by using it at high temperature, in combination with a good coating adhesion and a low yield ratio. Furthermore, because of the metallurgy of the steel, the mechanical values are reconditioned through its use at high temperature.

The term "multiphase" used here designates that the major constituent phases of the steel are a ferrite phase and a martensite phase. Advantageously in addition of those two phases a low amount of a bainite phase and of a retained austenite phase could be present.

The term "yield ratio" designates the ratio: yield strength/tensile strength i.e. Re/Rm.

As a first object, the present invention is more particularly related to a steel composition characterised by:

A C-content, between 0.06 wt % (hereafter denoted as %) and 0.15%,

A Si-content, between 0.1% and 0.4%,

A Mn-content, lower than 1.5%,

A Cr-content, between 0.2% and 0.5%,

A Mo-content, between 0.1% and 0.25%, so that the following condition is met: $Cr+2Mo \geqq 0.7\%$.

As a second object, the invention also relates to a method of producing a cold-rolled, metal coated, multi-phase steel having the above composition, said method comprising the steps of:

preparing a steel sheet by slab reheating, hot rolling and cold rolling, soaking said cold-rolled steel sheet at a temperature between Ac1 and Ac3, performing a primary cooling down to the temperature of the molten metal bath, with a cooling rate, higher than 25° C. per second, performing the hot dip metal coating of said steel sheet, performing a secondary cooling of said steel sheet to a temperature lower than Ms, with a cooling rate, higher than 4° C. per second, performing a skin-pass reduction between 0% and 0.4%.

As a third object, the invention also relates to the end product, which is a steel product having said composition, which is produced by said method and which is characterised by:

a tensile strength of at least 500 MPa, a yield ratio lower than 0.65 in skinned condition and lower than 0.6 in unskinned condition.

in the case of the aluminised steel, a temperature corrosion resistance up to a temperature of 900° C.

BRIEF DESCRIPTION OF THE DRAWINGS

FIGS. 3*a* and 3*b* are representing industrial trial results, for galvanised steel according to the present invention, wherein:

(3*a*) represents the obtained yield-strength (Re) and the tensile strength (Rm) respectively while (3*b*) represents the obtained yield ratio (Re/Rm) as a function of the soaking temperature.

Figure 4:
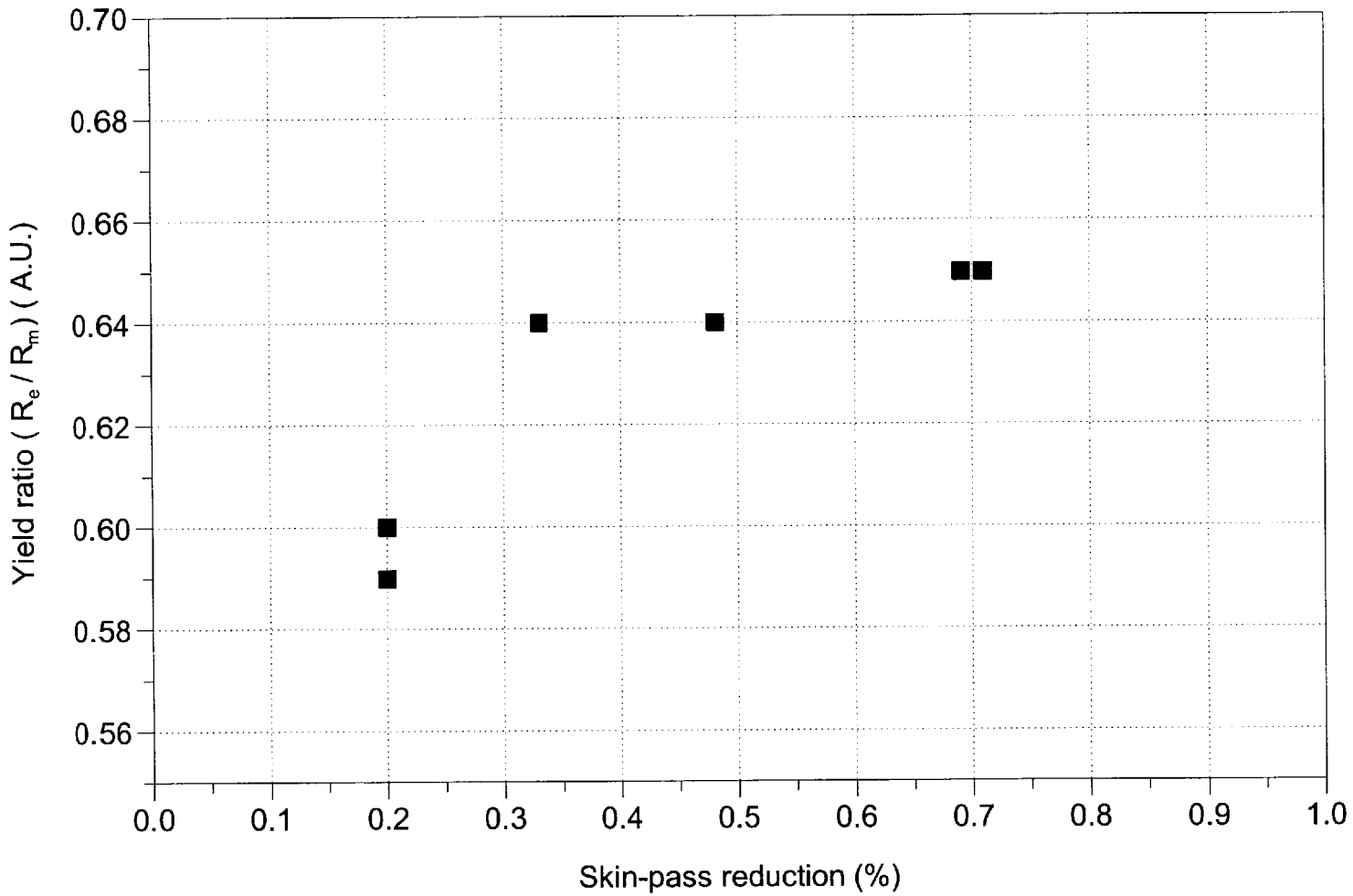

FIG. 4 represents the influence of the skin-pass reduction on the yield ratio of the galvanised steel product according to the present invention.

Figure 5:
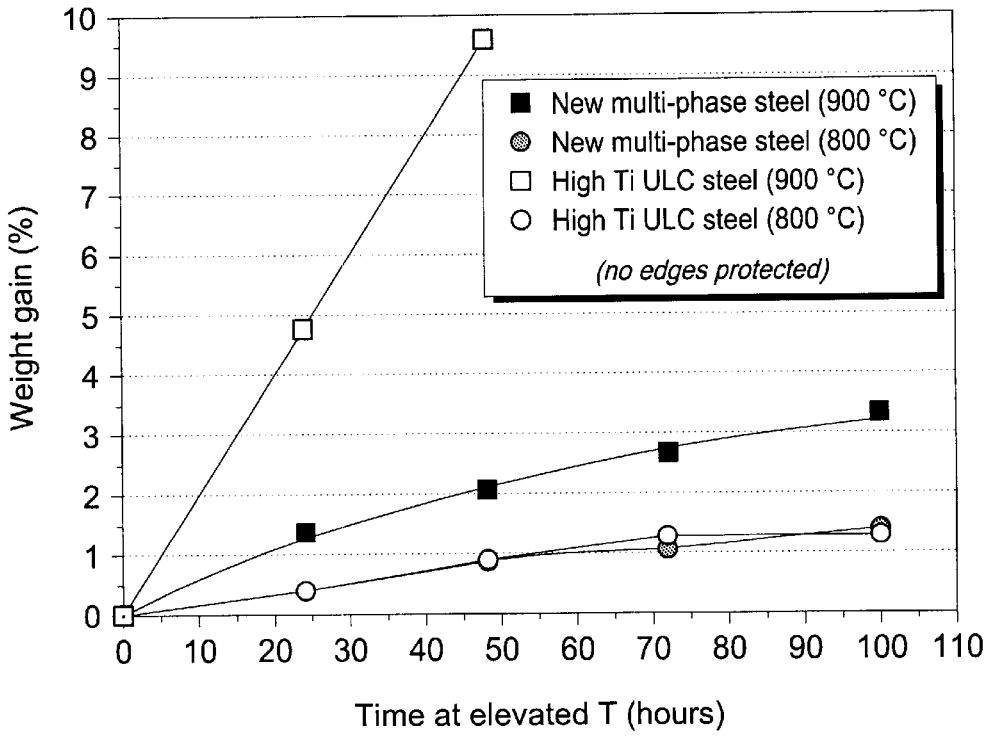

FIG. 5 represents the temperature resistance of aluminised steel according to the present invention, compared to existing steels.

Figure 6:
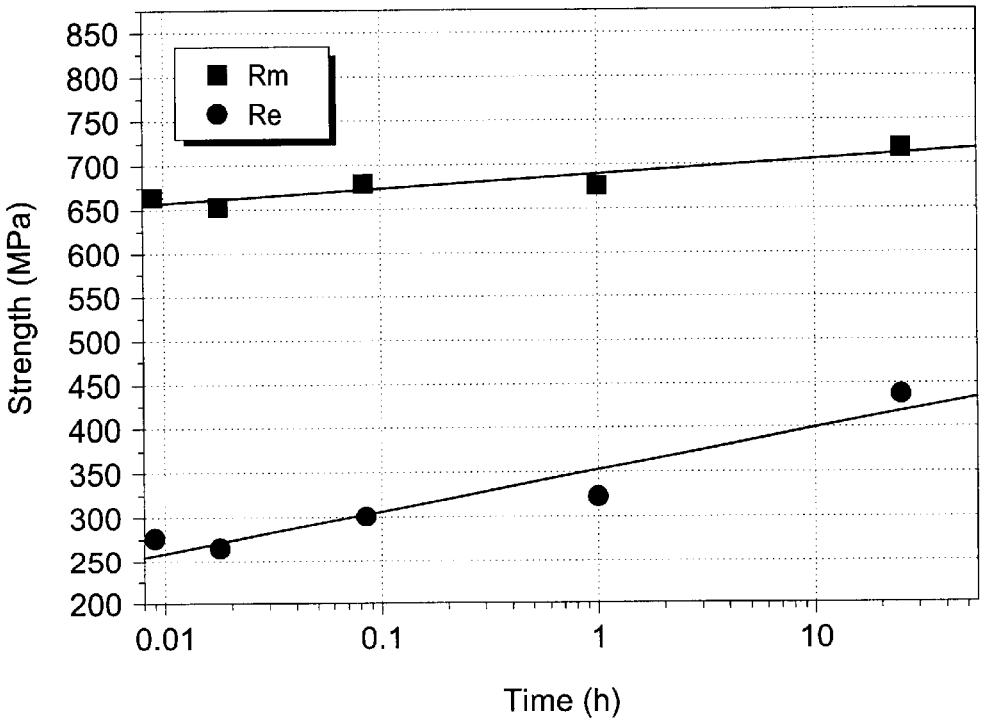

FIG. 6 represents the strength in terms of yield strength Re and tensile strength Rm as a function of the number of hours spent at a high temperature.

Figure 7:
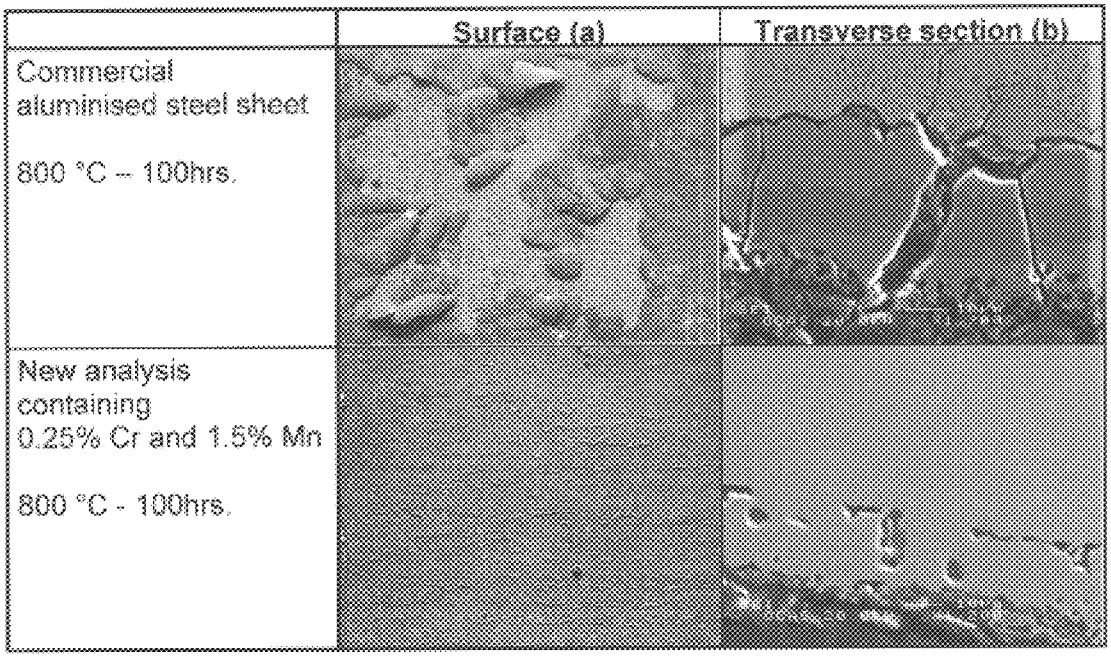

FIG. 7 compares the coating quality of an aluminised steel according to the present invention to that of an existing steel, after a prolonged exposure to 800° C.

Figure 8:
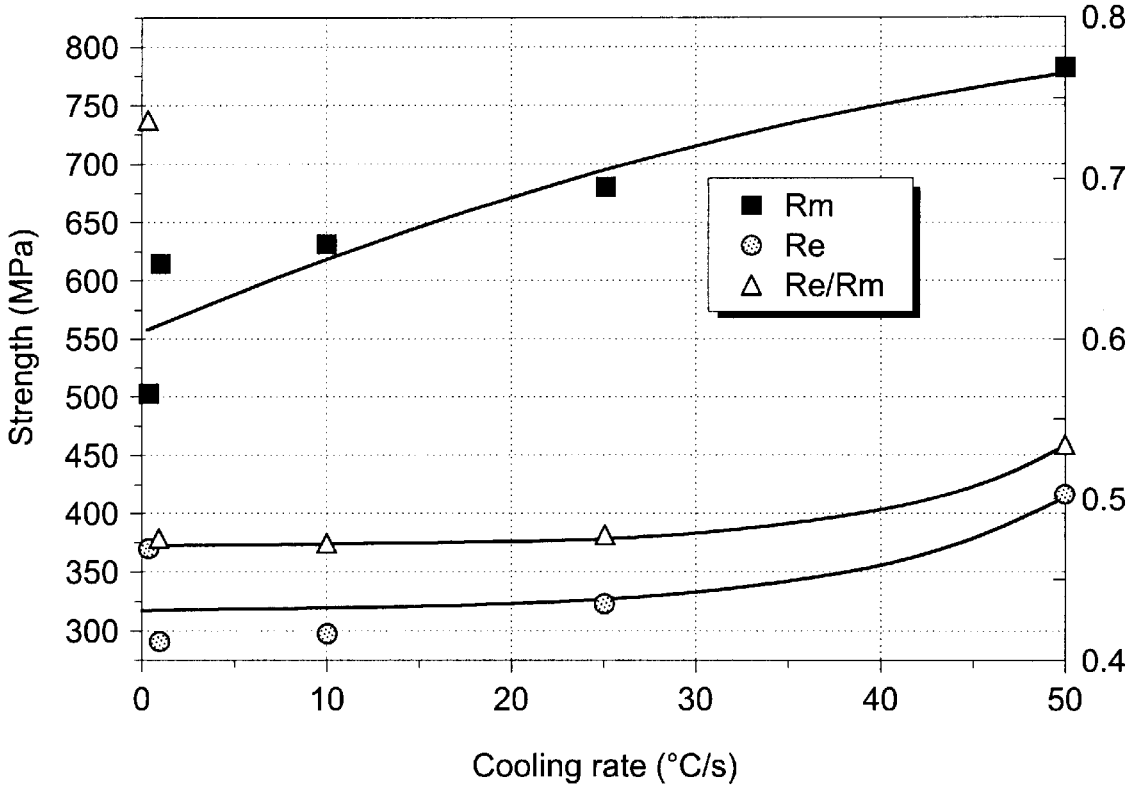

FIG. 8 illustrates the ability of the aluminised steel according to the present invention to retain its mechanical properties after cooling from a high temperature (reconditioning of the steel).

DESCRIPTION OF PREFERRED EMBODIMENTS

The following description is related to two embodiments of the method according to the present invention, namely for the production of a preferred galvanised steel sheet and for the production of a preferred aluminised steel sheet.

Figure 1:
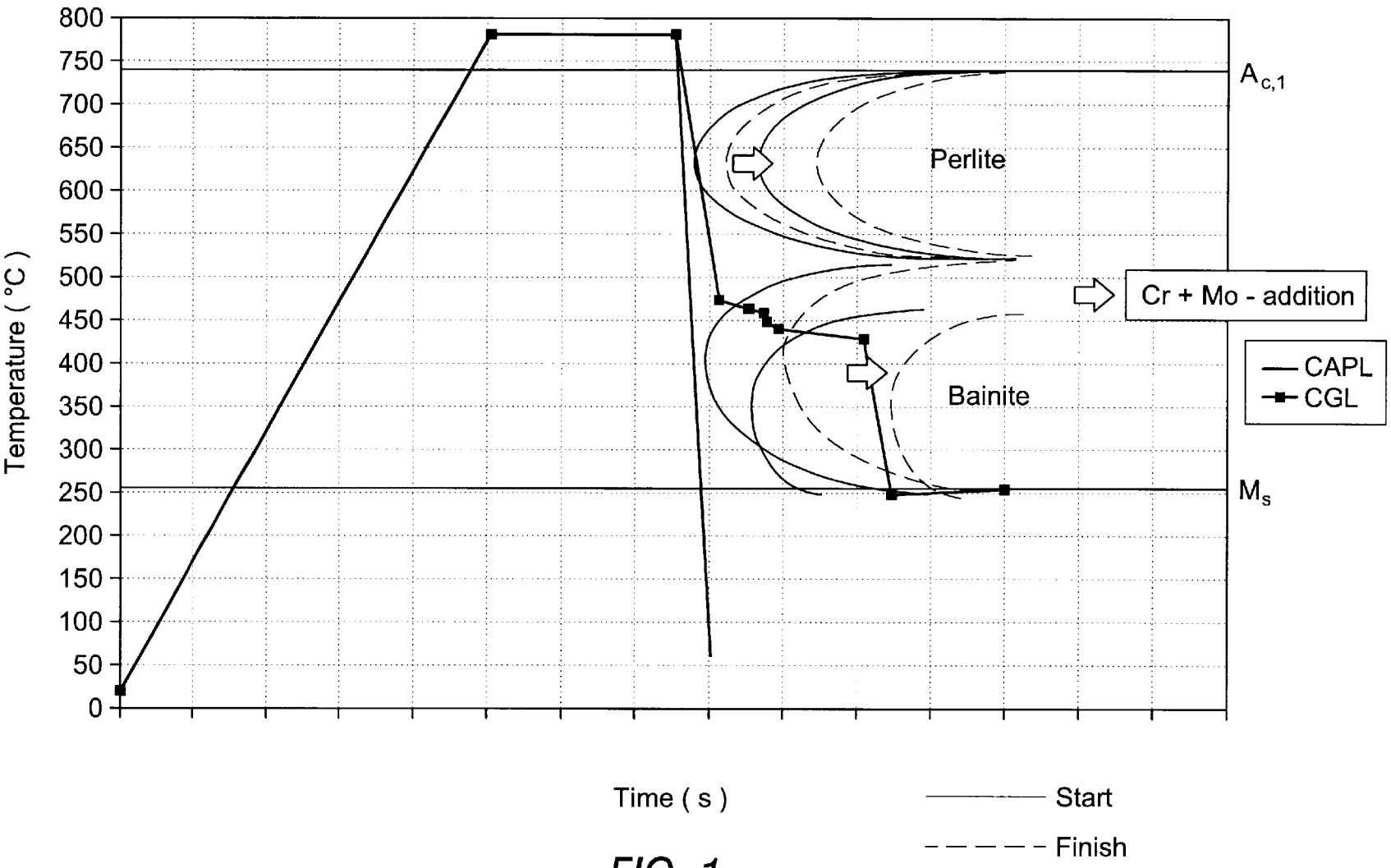
FIG. 1 represents a schematic view of the annealing treatment at the hot dip coating line according to the method of the present invention. Additions of Cr and Mo retard the austenite transformation into perlite and bainite.

For the development of a quality of steel sheets as required by the automobile industries, a compromise has to be found between the coating properties and the mechanical properties. Sufficient alloying elements need to be added to increase the quenchability, i.e. elements that prevent as much as possible the transformation of the austenite (formed at soaking temperature) into bainite before reaching the Ms (Martensite Start) temperature. The quenching effect is more difficult to obtain on a hot dip coating line due to the processing through the molten metal bath and therefore the inevitable quasi-isotherm remaining at the molten metal temperature (400° C. to 700° C.). This is schematically represented in FIG. 1.

Elements that can theoretically be taken into account to increase the quenchability are B, C, Mo, Cr, Si, and Mn. As it has been discussed in the state of the art section, too high levels of Cr and Mn lead to a deterioration of the coating layer adhesion.

However, in the case of the aluminised steel sheet, these elements (Mn and Cr, also Ti) are essential in avoiding the formation of brittle Fe—Al—Si compounds during the use at high temperatures, which are detrimental for the coating adhesion. The presence of Mn, Cr and Ti is beneficial for the phenomenon of interdiffusion of Fe and Al, which causes the coating to dissolve in the steel, leaving a ferrite phase at the surface with a high Al-content and an excellent high temperature corrosion resistance.

With the coating requirements as a major motive, a specific combination of Cr and Mo has been found to give the best results according to the present invention.

More preferably the steel composition, for a 600 MPa strength combined with a yield ratio lower than 0.65, is defined by the following contents:

C-content: comprised between 0.095 and 0.125. The C-content is determined by the desired strength level.

Mn-content: comprised between 1.35 and 1.50%. The Mn-content is a cheap alloying element increases the quenchability. Its level is limited to ensure a sufficient metal coating adhesion for unexposed and exposed automobile parts. The Mn-content also plays an effective role in the interdiffusion of Fe and Al, in the case of an Al-coating.

Si-content: comprised between 0.1 and 0.15%. The Si-content is essentially important for hardness and for the flash butt weldability, but has to be limited to ensure sufficient coating adhesion and surface quality.

Figure 2:
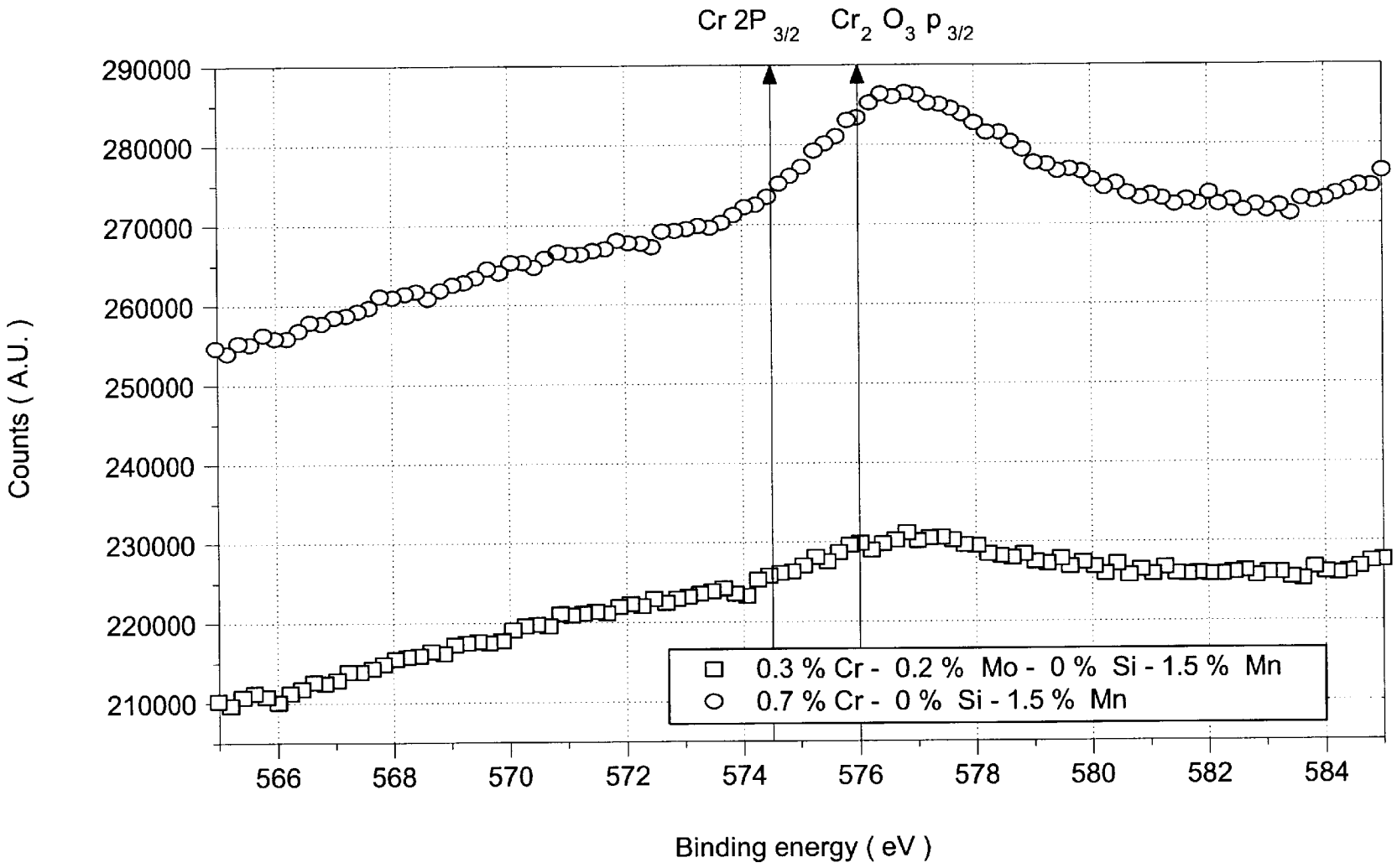
FIG. 2 represents the influence of Cr-addition on the formation of $Cr_2O_3$ on the surface of the steel sheet after soaking and before hot dip coating.

Cr-content: higher than 0.2% (for quenchability and for obtaining interdiffusion, in the case of Al-coating) and lower than 0.5% (coating adhesion), preferably between 0.2% and 0.4%, and more preferably between 0.2% and 0.3%. The Cr-content is essentially important for quenchability and has to be strictly regulated to assure a sufficient coating adhesion. The effect of a higher Cr-content on the formation of Cr-oxides on the steel sheet surface after soaking and prior to dipping is illustrated in FIG. 2. Also, table I describes the growing occurrence of bare spots on the galvanized surface with increasing Cr-and/or Mn content. The appearance of bare spots is an indication of deteriorating metal coating adhesion.

Mo-content: comprised between 0.1 and 0.25%, preferably between 0.15 and 0.25%, more preferably between 0.2% and 0.25%, while the relation with the Cr-content is defined by: Cr+2Mo 0.7%. The Mo-content is essentially important for quenchability and allows limiting the Cr and Mn contents to an acceptable level assuring a sufficient coating adhesion in the case of hot dip metal coated steel.

The process is preferably characterised by the following steps:

Hot Rolling Mill

T1: slab-reheating temperature: above 1100° C.

T2: finishing temperature: 870° C.

T3: coiling temperature: between 640° C. and 670° C.

Cold Rolling Mill

Cold rolling reduction comprised between 55% and 63%

After this, there is a difference between the two embodiments of the invention, namely the galvanised steel and the aluminised steel.

In the case of galvanized steel, the next step is:

Hot dip zinc coating line

Soaking temperature: between 780° C. and 850° C., and more preferably at 810° C.

Dew point in the hot dip coating line lower than −20° C. at the temperatures above 650° C. and in the primary cooling stage.

Primary cooling rate >40° C./sec

Strip temperature at the entry of the molten metal bath: between 460 and 475° C., more preferably between 440° C. and 475° C.

Mean secondary cooling rate >4° C./s

Skin-pass reduction: 0.2%

Stretch leveller reduction 0%

Hot dip aluminizing line

Soaking temperature: between 780° C. and 850° C., and more preferably at 810° C.

Dew point in the hot dip coating line lower than −20° C. at the temperatures above 650° C. and in the primary cooling stage.

Primary cooling rate >40° C./sec

Strip temperature at the entry of the molten metal bath: between 670° C. and 680° C., more preferably between 650° C. and 720° C.

Mean secondary cooling rate >4° C./sec

Skin-pass reduction: 0%

Stretch leveller reduction: 0%

Figure 3A:
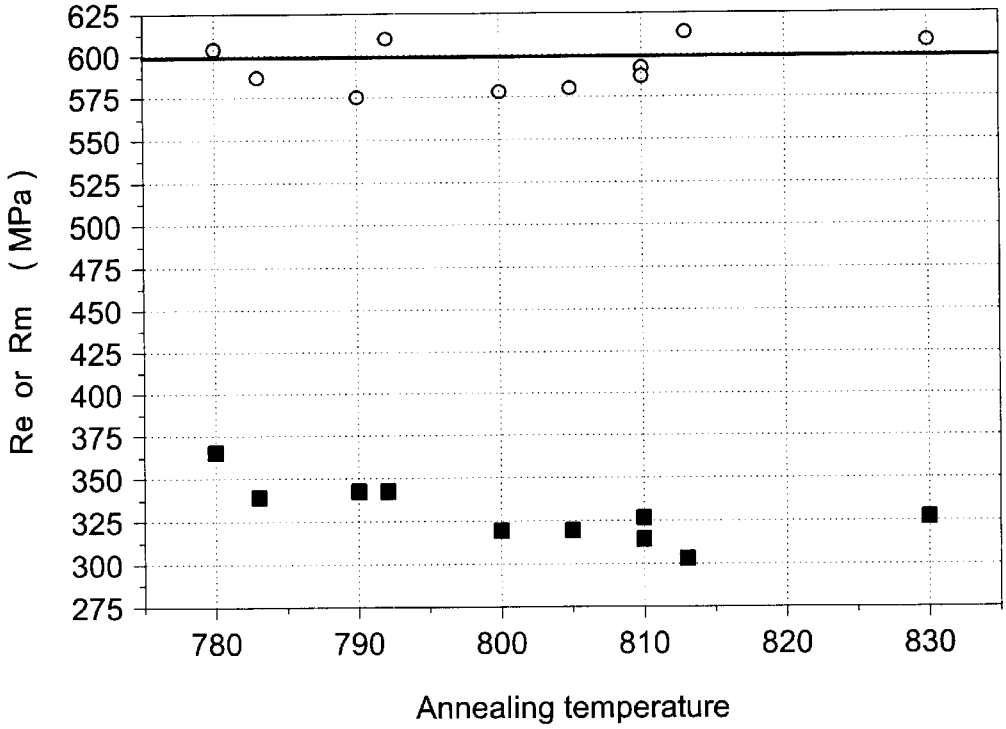
Figure 3B:
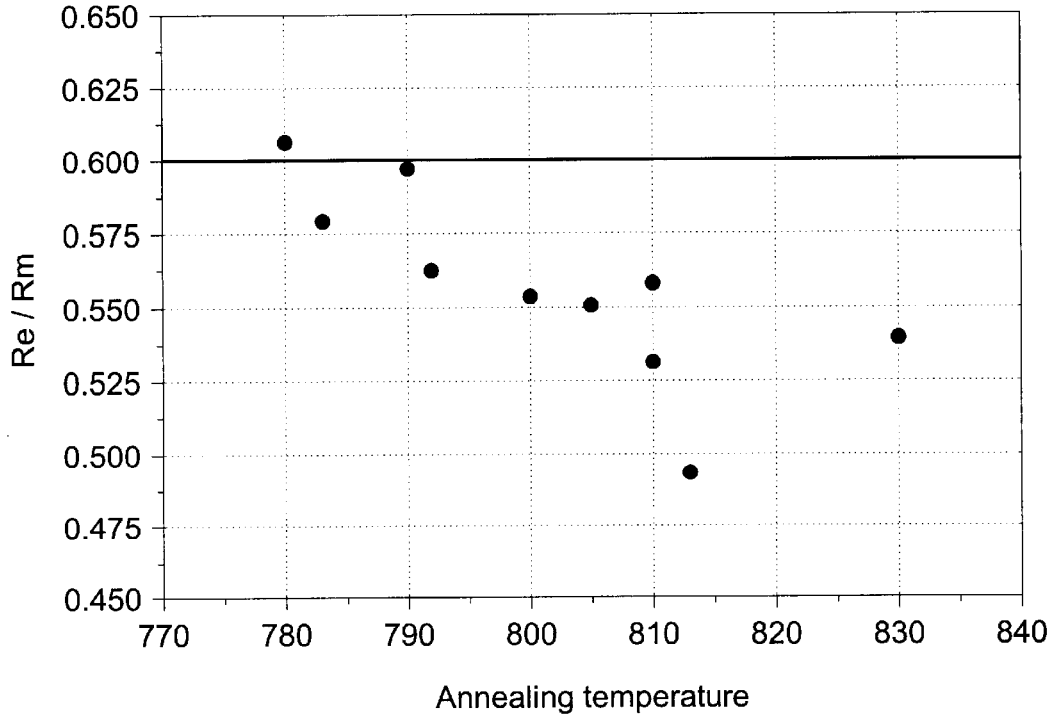

The obtained industrial results are represented in FIGS. 3 and 4 and Table II for galvanised steel and in Table III for aluminised steel.

FIGS. 5 to 8 represent laboratory results for the aluminised steel according to the invention. FIG. 5 illustrates the temperature resistance of the present steel, by way of its weight increase as a function of temperature. The reference 'High Ti ULC steel' refers to a commercially available Al-coated steel with a temperature resistance up to 800° C. The weight increase of the new steel is significantly lower at 900° C., which is a consequence of the interdiffusion of Al and Fe, avoiding the formation of a brittle Fe—Al—Si layer and direct oxidation of the steel sheet.

FIG. 6 illustrates the conservation and even the slight rise in the mechanical properties (Re and Rm) of the aluminised steel as a function of the number of hours spent at a temperature of 900° C.

FIG. 7 illustrates the superior surface quality of the aluminised steel according to the present invention (no flaking at the surface (a) nor cracks in the coating layer (b)).

FIG. 8 illustrates the ability of the aluminised steel according to the invention to undergo a reconditioning during cooling, after an exposure to the high temperature. This phenomenon allows to retain the good mechanical properties of the steel, after repeated use at high temperature.

TABLE I

Influence of steel composition on the amount of bare spots (#/cm$^2$) detected after galvanising, using the thermal cycle as described within this document

| Cast N° | Cr | Mn | Si | Mo | Bare spots #/cm$^2$ |
|---|---|---|---|---|---|
| 1 | 0 | 1.54 | 0.12 | 0 | None |
| 2 | 0.25 | 1.44 | 0.12 | 0.2 | None |
| 3 | 0.25 | 1.47 | 0.12 | 0.2 | None |
| 4 | 0.26 | 1.39 | 0.12 | 0.2 | None |
| 5 | 0.5 | 1.5 | 0.08 | 0 | None |
| 6 | 0.7 | 1.5 | 0 | 0 | >20 |
| 7 | 0 | 1.9 | 0 | 0 | >10 |

TABLE II

Obtained industrial results of the galvanised steel product according to the present invention

| Sample N° | Skin-pass (%) | $R_e$ (MPa) | $R_m$ (MPa) | $A_{80}$ (%) | $n_{10\text{-}UE}$ | YPE (%) | $R_e/R_m$ |
|---|---|---|---|---|---|---|---|
| 1 | 0.69 | 375 | 573 | 26 | 0.176 | 0 | 0.65 |
| 2 | 0.71 | 370 | 573 | 26 | 0.178 | 0 | 0.65 |
| 3 | 0.48 | 382 | 592 | 24 | 0.159 | 0 | 0.64 |
| 4 | 0.33 | 363 | 571 | 22 | 0.162 | 0 | 0.64 |
| 5 | 0.2 | 351 | 595 | 26 | 0.168 | 0 | 0.59 |
| 6 | 0.2 | 352 | 590 | 24 | 0.168 | 0 | 0.60 |

TABLE III

Mechanical properties of the aluminised steel according to the present invention

| | $R_m$ (MPa) | $R_{e0,2}$ (MPa) | $R_e/R_m$ | $A_{80}$ (%) | $A_u$ (%) | $n_{10\text{-}UE}$ | YPE (%) |
|---|---|---|---|---|---|---|---|
| Transverse | 614 | 285 | 0.46 | 20 | 15 | 0.209 | 0 |
| Longitudinal | 608 | 280 | 0.46 | 21 | 15 | 0.206 | 0 |

What is claimed is:

1. A method of producing a cold-rolled, metal coated, multi-phase steel, comprising the following steps:

preparing a steel slab having a composition comprising:

a C-content, between about 0.06% and 0.15%, a Si-content, between about 0.1% and 0.4%, a Mn-content, lower than about 1.5%, a Cr-content, between about 0.2% and 0.5%, a Mo-content, between about 0.1% and 0.25%, wherein Cr+2Mo≧0.7%, preparing a steel sheet by slab re-heating, hot-rolling and cold-rolling, soaking said cold-rolled steel sheet at a temperature of between Ac1 and Ac3, performing a primary cooling down at a cooling rate higher than 25° C. per second, performing a hot dip metal coating of said steel sheet, performing a secondary cooling of said sheet to a temperature lower than Ms, with a cooling rate higher than 4° C. per second, and performing a skin-pass reduction between about and 0% and 0.4%.

2. The method according to claim 1, wherein the cooling rate during the primary cooling step is higher than 40° C. per second.

3. The method according to claim 1, wherein the steel sheet is galvanized in a molten zinc bath and the temperature of the steel sheet upon entry into the molten zinc bath is between about 440° C. and 475° C.

4. The method according to claim 1, wherein the steel sheet is aluminized in a molten aluminum bath and the temperature of the steel sheet upon entry into the molten aluminum bath is between about 650° C. and 720° C.

5. The method according to claim 1, wherein the soaking is performed at a temperature of between about 780° C. and 850° C.

6. The method according to claim 1, wherein the steel sheet is galvanized and the skin-pass reduction is 0.2%.

7. A cold-rolled, metal-coated, multiphase product, having a steel composition comprising:

a C-element of between about 0.06% and 0.15%, a Si-element of between about 0.1% and 0.4%, a Mn-element, lower than about 1.5%, a Cr-element of between about 0.2% and 0.5%, and a Mo-element between about 0.1% and 0.25%, wherein Cr+2Mo≧0.7%, said product having a tensile strength of at least 500 MPa, and a yield ratio lower than 0.65 in skinned condition.

8. The product of claim 7, wherein said product has a temperature corrosion resistance up to a temperature of about 900° C.

9. A cold-rolled, metal coated, multiphase product, having a steel composition comprising:

a C-element between about 0.06% and 0.15%,

A Si-element between about 0.1% and 0.4%, a Mn-element, lower than 1.5%, a Cr-element between about 0.2% and 0.5%, and a Mo-element between about 0.1% and 0.25%, wherein Cr+2Mo≧0.7%, said steel having a tensile strength of at least 500 MPa, and a yield ratio lower than 0.6 in unskinned condition.

10. The product of claim 9, wherein said product has a temperature corrosion resistance up to a temperature of about 900° C.

* * * * *